US006537664B2

(12) United States Patent
Nakajima

(10) Patent No.: US 6,537,664 B2
(45) Date of Patent: Mar. 25, 2003

(54) CLEANING SHEET FOR A FUSER MEMBER, A CLEANING SHEET SUPPLIER, AND A CLEANING APPARATUS

(75) Inventor: Masahiro Nakajima, Shiga (JP)

(73) Assignee: Japan Vilene Company, Ltd., Tokyo (JP)

( * ) Notice: Subject to any disclaimer, the term of this patent is extended or adjusted under 35 U.S.C. 154(b) by 0 days.

(21) Appl. No.: 09/841,093

(22) Filed: Apr. 25, 2001

(65) Prior Publication Data

US 2001/0044017 A1 Nov. 22, 2001

(30) Foreign Application Priority Data

Apr. 26, 2000 (JP) ..... 2000-125041

(51) Int. Cl.[7] ..... D02G 3/00

(52) U.S. Cl. ..... 428/401; 428/294.7; 428/308.4; 118/244; 118/258; 118/260

(58) Field of Search ..... 428/198, 200, 428/311.5, 422, 308.4, 294.7, 397, 401; 118/244, 247, 258, 260

(56) References Cited

U.S. PATENT DOCUMENTS 5,788,770 A * 8/1998 Hobson et al. ..... 118/244

* cited by examiner

*Primary Examiner*—Merrick Dixon
(74) *Attorney, Agent, or Firm*—Sughrue Mion, PLLC

(57) ABSTRACT

A cleaning sheet for a fuser member, comprising an ultrafine fibers-containing portion including (a) first ultrafine fibers formed from a resin having a softening point of higher than 230° C., having a non-circular cross-sectional shape, and having a fiber diameter of not more than 10 μm, and (b) second ultrafine fibers formed from a resin having a softening point of 150 to 230° C., and having a fiber diameter of not more than 10 μm, wherein at least one surface of the cleaning sheet is contained in the ultrafine fibers-containing portion, and the second ultrafine fibers in a surface portion containing the surface are deformed by press-attaching is disclosed.

11 Claims, 3 Drawing Sheets

CLEANING SHEET FOR A FUSER MEMBER, A CLEANING SHEET SUPPLIER, AND A CLEANING APPARATUS

BACKGROUND OF THE INVENTION

1. Field of the Invention

The present invention relates to a cleaning sheet for a fuser member, such as a fuser roll, a cleaning sheet supplier for a fuser member, such as a fuser roll, and a cleaning apparatus for a fuser member, such as a fuser roll.

2. Description of the Related Art

In electronic photography apparatuses, such as copying machines, laser beam printers, or facsimiles, hitherto, a printing sheet, such as a paper or a film, carrying thereon an unfixed toner image was supplied between a fuser roll and a pressing roll, and the image was fixed on a surface of the printing sheet by the functions of heat and pressure. Therefore, a problem arose in that the toner was transferred to surfaces of the fuser roll and/or the pressing roll, the transferred toner was re-transferred to a rear end of the printing sheet or a next printing sheet, and thus the printing sheet was stained with the toner, that is, a problem of off-set. To avoid such a problem, the fuser roll is coated with an oil to enhance the release properties of the toner transferred on the surface of the fuser roll, and the toner is removed with a cleaning sheet.

The fixing mechanism of a toner image will be explained, referring to FIG. 1, a sectional view schematically illustrating a fixing apparatus. A printing sheet 3 carrying an unfixed toner image 3*a* thereon is supplied between a fuser roll 1 and a pressing roll 2. When the printing sheet 3 is passed through the fuser roll 1 rotating in a direction of the arrow A shown in FIG. 1 and the pressing roll 2 rotating in a direction of the arrow B shown in FIG. 1, the unfixed toner image 3*a* is fixed on the printing sheet 3 by heat and pressure. Then, the printing sheet 31 carrying the fixed toner image 3*b* thereon is moved in a direction of the arrow C shown in FIG. 1.

Further, the fuser roll 1, before coming into contact with the printing sheet 3, is coated with an oil 4*a* supplied from an oil-coating device 4 via oil supplying rolls 4*b* to enhance the release properties of the toner. Then, the unfixed toner image 3*a* is fixed on the printing sheet 3 by the fuser roll 1, and the fuser roll 1 rotates while carrying an unfixed toner thereon. The toner on the fuser roll 1 is removed by a cleaning sheet 5.

As above, the oil 4*a* is applied on the fuser roll 1 to remove the transferred toner. Therefore, not only the toner image 3*b*, but also the oil applied on the fuser roll 1 is transferred to the printing sheet 31. When the printing sheets 3, 31 are made of paper, and have a surface region not covered by the fixed toner, the oil is absorbed into such a surface region. Therefore, no major problem arises with respect to the oil transfer. However, when a whole surface of the printing sheet 3 is covered with the fixed toner, for example, where a photograph is reproduced by a color copying machine, or the like, the oil cannot be absorbed into the printing sheet surface that is entirely covered with the toner. Therefore, a problem arose in that uneven oil strips were formed on the fixed toner image, and thus the image quality was impaired. Further, when the printing sheet is made of a film having a poor absorbability of oil, the printing sheet cannot absorb the oil. Therefore, a problem arose in that the oil remained on the fixed toner image, and thus the image quality was impaired.

When an oil-coating device 4 as shown in FIG. 1 is used, the fuser roll 1 is coated with an oil, after the surface of the fuser roll 1 is wiped off by the cleaning sheet 5. A conventional cleaning sheet 5 is pressed onto the surface of the fuser roll 1 by a pinch roll 8 to remove the toner on the surface of the fuser roll 1, while the cleaning sheet is conveyed from a supplying shaft 6 around which the cleaning sheet 5 is wound, to a take-up shaft 7, in a direction of the arrow D as shown in FIG. 1, or in an opposite direction. When the toner is removed, however, there is a tendency for the oil to be unevenly removed from the fuser roll 1 by the cleaning sheet, and thus, as shown in FIG. 2, a residual oil layer 41 having an uneven thickness is formed on the surface of the fuser roll 1. Therefore, even if the oil is uniformly applied by the oil-coating device 4, a new oil layer 42 is formed, as shown in FIG. 3, in such a manner that the unevenness in the thickness of the residual oil layer 41 on the surface of the fuser roll 1 is aggravated. As a result, the oil is unevenly transferred onto the toner image fixed on the printing sheet, striped oil layers are formed, and thus the image quality is considerably impaired.

To remedy such defects, an attempt to uniformly remove the oil by strongly pressing the cleaning sheet 5 against the fuser roll 1 was made. However, there arose problems in that the fuser roll was easily damaged due to the strong pressure applied by the cleaning sheet 5, and thus the lifetime of the fuser roll 1 was shortened, or friction between the fuser roll 1 and the cleaning sheet 5 was increased, and thus mechanical vibration occurred.

Further, an attempt to reduce an amount of the oil applied from the oil-coating device 4 to the fuser roll 1 was conducted. However, the decrease in the amount of oil caused problems such that the release properties of the oil became worse, and off-set easily occurred.

Furthermore, instead of directly bringing the cleaning sheet 5 into contact with the fuser roll 1, an attempt to install a transfer roll capable of transferring the residual toner from the fuser roll 1, and bring the cleaning sheet 5 into contact with the transfer roll to thereby remove the residual toner and oil was made. However, it was impossible to completely remove the oil strips from the printing sheet.

Still further, a cleaning sheet containing an impregnated oil for removing a transferred toner from the fuser roll and applying the oil onto the fuser roll is known, as used in a fuser member, such as a fuser roll, in an electronic photography apparatus. In this case, however, a thickness of the oil applied on the fuser roll became uneven, and as a result, the oil was unevenly transferred onto the toner image fixed on the printing sheet, striped oil layers were formed, and thus the image quality was considerably impaired.

For example, Japanese Patent No. 2805221 discloses a cleaning sheet for a fuser roll in a copying machine, which comprises a thermally press-bonded nonwoven fabric sheet containing an impregnated silicone oil, and composed of ultrafinely divided fibers obtained from composite fibers having two or more resin components, and a radially cross-sectional shape, or of the above-mentioned ultrafinely divided fibers and thermoplastic fibers, wherein one of the divided fibers is a super-ultrafine fiber having a mostly triangular cross-sectional shape, and made of a heat-resistant resin component, such as 4–6-nylon, aromatic polyester, or aromatic polyamide. The cleaning sheet for a fuser roll can form a silicone oil layer on a fuser roll more uniformly than that formed by a conventional cleaning sheet. However, this was still insufficient.

SUMMARY OF THE INVENTION

An object of the present invention is to remedy the above defects. More particularly, the object of the present invention is to provide a cleaning sheet for a fuser member which can uniformly wipe off and remove an oil on a surface of the fuser member, and/or form an oil coating layer having an uniform thickness, without shortening a lifetime of the fuser member, such as a fuser roll, without causing mechanical vibration, or without impairing the release properties of toners, and to provide a supplier of the cleaning sheet for a fuser member, and a cleaning apparatus for a fuser member comprising the supplier.

Other objects and advantages will be clear from the following description.

According to the present invention, there is provided a cleaning sheet for a fuser member, comprising an ultrafine fibers-containing portion including (a) first ultrafine fibers (hereinafter sometimes referred to as the ultrafine fibers A) formed from a resin having a softening point of higher than 230° C., having a non-circular cross-sectional shape, and having a fiber diameter of not more than 10 $\mu$m, and (b) second ultrafine fibers (hereinafter sometimes referred to as the ultrafine fibers B) formed from a resin having a softening point of 150 to 230° C., and having a fiber diameter of not more than 10 $\mu$m, wherein at least one surface of the cleaning sheet is contained in the ultrafine fibers-containing portion, and the second ultrafine fibers in a surface portion containing the surface are deformed by press-attaching.

The cleaning sheet for a fuser member of the present invention has excellent properties for wiping off of a toner and an oil. This is believed to be because the cleaning sheet of the present invention contains the first ultrafine fibers, i.e., the ultrafine fibers A, in a surface to be brought into contact with the fuser member, such as a fuser roll, and the second ultrafine fibers, i.e., the ultrafine fibers B, are not fused, but deformed by press-attaching, namely, press-attachedly deformed. Further, the cleaning sheet of the present invention has a smooth surface, has a large area able to come into contact with the fuser member, such as a fuser roll, exhibits an excellent removability of an oil, and is capable of forming an oil layer having a uniform thickness. This is believed to be because the surface able to come into contact with the fuser member, such as a fuser roll, contains the ultrafine fibers B in the press-attachedly deformed state. Furthermore, the cleaning sheet of the present invention provides a far greater removability of the oil, and can form a more uniform oil layer, in comparison with conventional cleaning sheets. This is also believed to be because the ultrafine fibers B in the cleaning sheet of the present invention are softened when brought into contact with the fuser member, such as the fuser roll, having a surface temperature of about 150° C. to 200° C., and therefore, the cleaning sheet of the present invention can be deformed to fit the shape of the fuser member.

According to the cleaning sheet of the present invention, as above, the oil removal is excellent, an oil layer having a uniform thickness can be formed, a lifetime of a fuser member, such as a fuser roll, is not shortened or mechanical vibration does not occur because it is not necessary to strongly press the cleaning sheet against a fuser member, such as a fuser roll, and a release property of a toner is not impaired because it is not necessary to reduce an amount of oil coated on a fuser member, such as a fuser roll, only by making use of the cleaning sheet of the present invention used as a conventional cleaning sheet.

Further, the present invention relates to a supplier of a cleaning sheet for a fuser member, comprising the cleaning sheet, a supply shaft around which the cleaning sheet is wound from an end thereof, and a take-up shaft to which the other end of the cleaning sheet is fixed.

The cleaning sheet supplier will always bring a fresh surface of the cleaning sheet into contact with a surface of a fuser member, such as a fuser roll, and therefore, oil on the surface of the fuser member can be uniformly removed, and an oil layer with a uniform thickness can be formed.

Further, the present invention relates to a cleaning apparatus for a fuser member, comprising the supplier, a means for holding the supplier, a means for conveying the cleaning sheet of the supplier, and a means for pressing the cleaning sheet to a fuser member.

The cleaning apparatus of the present invention will always bring a fresh surface of the cleaning sheet into contact with a surface of a fuser member, such as a fuser roll, and therefore, oil on the surface of the fuser member can be uniformly removed, and an oil layer with a uniform thickness can be formed.

DESCRIPTION OF THE PREFERRED EMBODIMENTS

Figure 1:
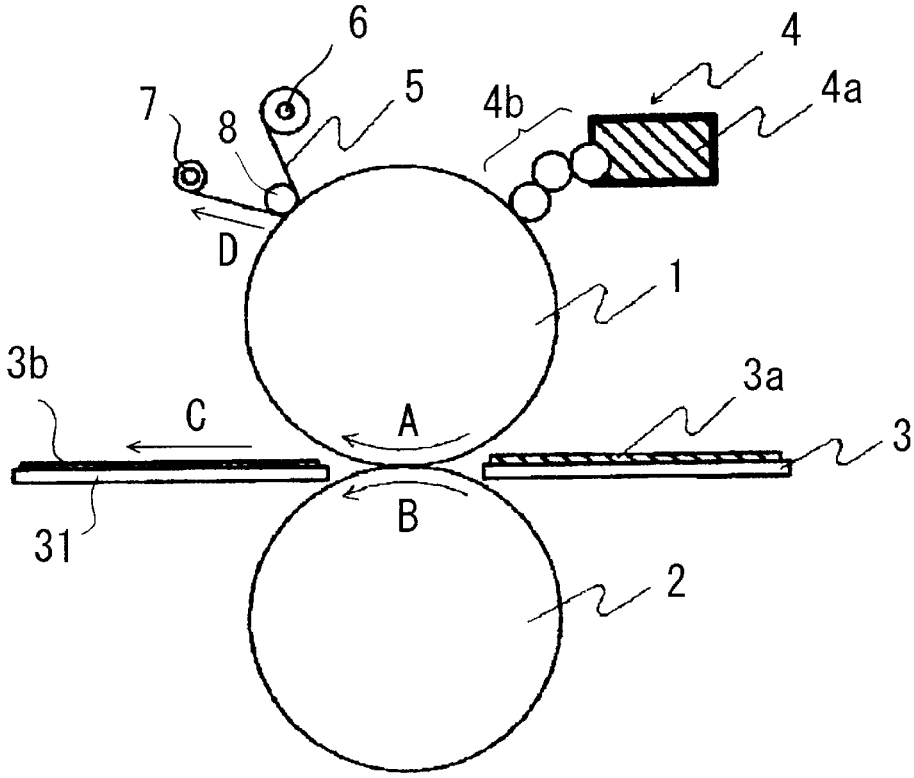
FIG. 1 is a sectional view schematically illustrating a mechanism of fixing a toner image by a conventional fuser member, such as a fuser roll.
Figure 2:
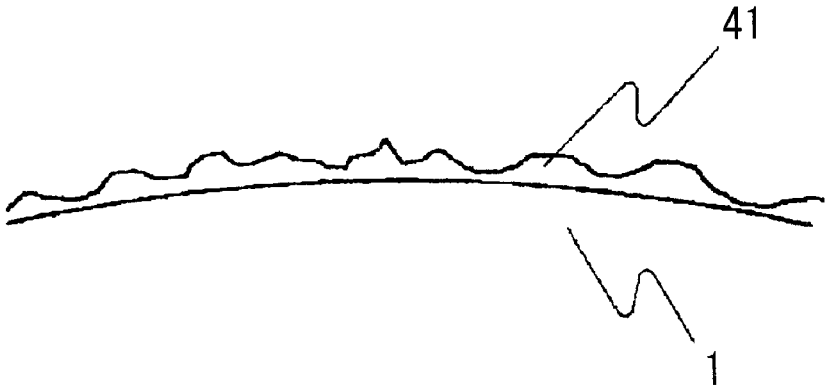
FIG. 2 is an enlarged sectional view schematically illustrating a thickness of an oil layer on a surface of a fuser roll after wiping off by a conventional cleaning sheet.
Figure 3:
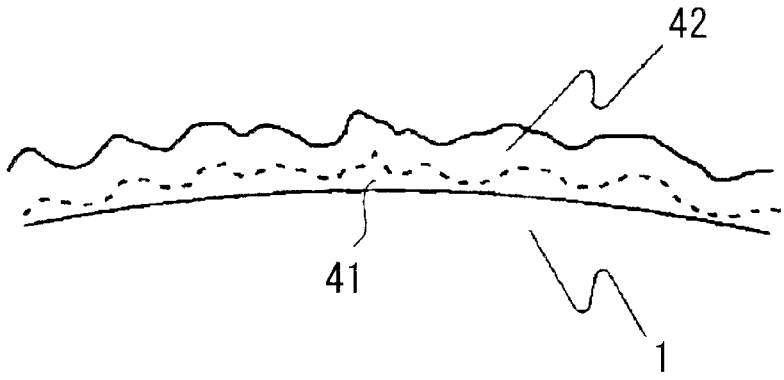
FIG. 3 is an enlarged sectional view schematically illustrating a thickness of an oil layer on a surface of a fuser roll after coating by a conventional oil-coating device.

The cleaning sheet of the present invention contains an ultrafine fibers-containing portion, that is a portion containing ultrafine fibers. The ultrafine fibers-containing portion contains at least one surface of the cleaning sheet, and has a layered structure or a mostly layered structure as mentioned below. The above surface is able to come into contact with the surface of a fuser member, such as a fuser roll.

The cleaning sheet of the present invention may be composed only of the ultrafine fibers-containing portion. In this embodiment, the ultrafine fibers-containing portion is in the form of a sheet.

The cleaning sheet of the present invention may be composed of the ultrafine fibers-containing portion and a second fibers-containing portion. In this embodiment, the ultrafine fibers-containing portion having a layered structure is laminated with the second fibers-containing portion having a layered structure. However, a two-layered structure is not clearly recognized, and therefore, the term "ultrafine fibers-containing portion" is used in the present specification, instead of the term "ultrafine fibers-containing layer".

The ultrafine fibers-containing portion in the cleaning sheet of the present invention contains a surface portion as a part thereof. The surface portion contains the press-attachedly deformed ultrafine fibers B, and contains a surface able to come into contact with a surface of a fuser member, such as a fuser roll. This surface will be hereinafter sometimes referred to as a contacting surface. Therefore, the ultrafine fibers-containing portion comprises the surface portion containing the contacting surface and an inner portion. The contacting surface-containing surface portion having a layered structure is laminated with the inner portion having a layered structure. However, a two-layered structure is not clearly recognized, and therefore, the term "surface portion" is used in the present specification, instead of the term "surface layer".

The cleaning sheet of the present invention comprises, as above, the ultrafine fibers-containing portion. The ultrafine fibers-containing portion contains the first ultrafine fibers, i.e., the ultrafine fibers A, formed from a resin having a softening point of higher than 230° C., having a non-circular cross-sectional shape, and having a fiber diameter of not more than 10 μm. It is believed that, because the cleaning sheet contains the ultrafine fibers A, the cleaning sheet can maintain a form of the ultrafine fibers-containing portion when it is brought into contact with a fuser member having an elevated surface temperature, such as a fuser roll having a surface temperature of about 150° C. to 200° C., a toner or oil can be efficiently removed, and the contacting surface can become flat in combination with the second ultrafine fibers, i.e., the ultrafine fibers B as mentioned below.

The softening point of the resin forming the ultrafine fibers A must be more than 230° C., preferably 235° C. or more, more preferably 238° C. or more, because the ultrafine fibers-containing portion must maintain its form when it is brought into contact with a fuser member having an elevated surface temperature, such as a fuser roll having a surface temperature of about 150° C. to 200° C. The resin forming the ultrafine fibers A is not particularly limited, so long as the resin has a softening point of higher than 230° C., for example, a polyamide, such as, nylon 66, polyethylene terephthalate, polyphenylene sulfide, or polyethylene naphthalate, preferably, polyethylene terephthalate.

The term "softening point" as used herein means a temperature of a starting point in a melting-endothermic curve obtained by raising a temperature from room temperature at a rate of 10° C./min, using a differential scanning calorimeter.

For the ultrafine fibers A, the cross-sectional fiber shape, i.e., a sectional shape in a direction crossing at right angles to a lengthwise direction of a fiber, is non-circular. This is believed to provide a cleaning sheet having an excellent removability of a toner and oil. The fiber having a non-circular cross-sectional shape is, for example, a fiber carrying on its surface one or more projections (in particular, sharp-angled projections) continuously extending in a lengthwise direction of a fiber. Specifically, the non-circular cross-sectional shape may be a polygon, such as a triangle or a quadrilateral, an alphabetical-letter-like shape, such as a Y-shape or an X-shape, an ellipse, or an oval. Of these shapes, the polygonal shape or the alphabetical-letter-like shape is preferable, as it provides an excellent removability of a toner or oil, and the polygonal shape (particularly, the almost triangular shape) is more preferable, as it provides a particularly excellent removability of a toner or oil.

Further, the fiber diameter of the ultrafine fibers A is 10 μm or less. Therefore, the contacting surface of the ultrafine fibers-containing portion may be made flat by the combined functions of the ultrafine fibers A and the ultrafine fibers B as mentioned below. Further, fine pores may be formed, and thus a good holdability of an oil is obtained. The fiber diameter is preferably 8 μm or less, more preferably 5 μm or less. A lower limit of the fiber diameter of the ultrafine fibers A is not particularly limited, but is appropriately about 0.01 μm.

The term "fiber diameter" as used herein means a diameter of a fiber where a cross-sectional shape thereof is circular. For a fiber having a non-circular cross-sectional shape, for example, the ultrafine fibers A, a diameter of a circle having an area the same as that of the non-circular cross-sectional shape is regarded as the diameter in the present specification.

The ultrafine fibers-containing portion of the cleaning sheet of the present invention contains, in addition to the ultrafine fibers A as above, the second ultrafine fibers, i.e., the ultrafine fibers B, formed from a resin having a softening point of 150 to 230° C., and having a fiber diameter of not more than 10 μm. It is believed that, because the cleaning sheet contains the ultrafine fibers B, the cleaning sheet can come into close contact with a fuser member, such as a fuser roll, and therefore, oil can be uniformly removed, and an oil layer having a uniform thickness can be formed.

It is believed that, because the resin forming the ultrafine fibers B has a softening point of 150° C. to 230° C., the ultrafine fibers B may be softened and deformed along a shape of the surface of the fuser member, such as a fuser roll, when the cleaning sheet is brought into contact with a fuser member having an elevated surface temperature, such as a fuser roll having a surface temperature of about 150° C. to 200° C., and therefore, oil can be uniformly removed, and an oil layer having a uniform thickness can be formed.

When the cleaning sheet contains oil, the oil is squeezed out by the deformation of the ultrafine fibers B, and thus the fuser member, such as the fuser roll, can be coated with a large amount of the oil.

The softening point of the resin forming the ultrafine fibers B is preferably 150° C. to 210° C., more preferably 150° C. to 190° C.

The resin forming the ultrafine fibers B is not particularly limited, so long as the resin has a softening point of 150° C. to 230° C., for example, a polyamide, such as nylon 6, acrylate resin, vinylon, polyvinylidene, acetate resin, or polybutylene terephthalate, preferably a polyamide, such as nylon 6.

For the ultrafine fibers B, the cross-sectional fiber shape, i.e., a sectional shape in a direction crossing at right angles to a lengthwise direction of a fiber is preferably non-circular, before they are press-attachedly deformed. The ultrafine fibers B are press-attachedly deformed at least in the surface portion of the ultrafine fibers-containing portion, and preferably have a non-circular cross-sectional shape in the press-attachedly deformed condition. It is believed that when the cross-sectional fiber shape of the ultrafine fibers B is non-circular after press-attachedly deformed, a cleaning sheet providing an excellent removability of the toner and oil can be obtained. Specifically, the non-circular cross-sectional shape before or after press-attachedly deformed may be, as for the shape of the ultrafine fibers A, a polygon, such as a triangle or a quadrilateral, an alphabetical-letter-like shape, such as a Y-shape, an X-shape or an I-shape, an ellipse, or an oval. Of these shapes, the polygonal shape or the alphabetical-letter-like shape is preferable after press-attachedly deformed, because of a greater contribution thereby to a removability of a toner or oil, and the alphabetical-letter-like shape is more preferable before press-attachedly deformed, because the ultrafine fibers B having such a shape can be easily press-attachedly deformed to form a flat surface as mentioned below.

The fiber diameter of the ultrafine fibers B is 10 μm or less. Therefore, the contacting surface of the ultrafine fibers-containing portion may be made flat by the combined functions of the ultrafine fibers A as mentioned above and the ultrafine fibers B. Further, fine pores may be formed, and thus a good holdability of an oil is obtained. The fiber diameter is preferably 8 μm or less, more preferably 6 μm or less. A lower limit of the fiber diameter of the ultrafine fibers B is not particularly limited, but is appropriately about 0.01 μm.

The ultrafine fibers B in the ultrafine fibers-containing portion are press-attachedly deformed at least in the surface portion containing the contacting surface. It is believed that the contacting surface of the ultrafine fibers-containing portion may be made flat, oil can be uniformly removed, and an oil layer having a uniform thickness can be formed.

The ultrafine fibers B may be in a press-attachedly deformed state over an entire ultrafine fibers-containing portion. However, it is preferable that the ultrafine fibers B are press-attachedly deformed only in a part of the ultrafine fibers-containing portion. In this case, a larger amount of the oil removed can be held in a press-attachedly undeformed portion, and a larger amount of the oil that has been impregnated in advance can be held thereat.

The term "surface portion of the ultrafine fibers-containing portion" as used herein means, for example, a portion ranging from the surface of the ultrafine fibers-containing portion to a depth of 5 μm therefrom in a thickness direction of the ultrafine fibers-containing portion. The term "surface of the ultrafine fibers-containing portion" as used herein means a hypothetical surface that comes into contact with a back surface of a plate having an area density of 1 g/1 $cm^2$ when the flat plate is laminated on the ultrafine fibers-containing portion. Further, in the present specification, a thickness direction of the ultrafine fibers-containing portion means a direction crossing at right angles to the surface of the ultrafine fibers-containing portion. Furthermore, a distance in the thickness direction of the ultrafine fibers-containing portion means a distance from the surface of the ultrafine fibers-containing portion when measured by laminating the plate having an area density of 1 g/1 $cm^2$ on the ultrafine fibers-containing portion.

In the present specification, the press-attachedly deformed state means a state wherein resins are attached not by softening the resins, but only by a deformation produced by an applied pressure, and the attachment is formed by pressing and deforming resins at a temperature of less than a softening point of the resins, without softening the resins.

The ultrafine fibers-containing portion of the cleaning sheet of the present invention may be composed only of the ultrafine fibers A and the ultrafine fibers B, but may contain fibers capable of imparting another function or functions; hereinafter sometimes referred to as function-imparting fibers C.

The function-imparting fibers C may be, for example, fibers having a fiber diameter of more than 10 μm and a softening point of more than 230° C., for example, a polyamide fiber, such as a nylon 66 fiber, a polyethylene terephthalate fiber, a polyphenylene sulfide fiber, or a polyethylene naphthalate fiber; or fibers made of a non-fusible resin, such as a meta- or para-whole aromatic polyamide fiber, a whole aromatic polyester fiber, a polyamide imide fiber, an aromatic polyether amide fiber, or a polybenzimidazol fiber. The function-imparting fibers C can enhance the heat resistance, and as a result, a temperature of a fuser member, such as a fuser roll, can be raised, and thus, a fixing rate can be increased.

The ultrafine fibers-containing portion can contain, as the function-imparting fibers C, for example, metallic fibers, plated fibers, or fibers containing abrasive particles to thereby enhance a removability of the toner.

A mass ratio of the ultrafine fibers A, the ultrafine fibers B and the function-imparting fibers C (such as fibers having a fiber diameter of more than 10 μm and a softening point of more than 230° C., fibers made of a non-fusible resin, metallic fibers, plated fibers, or fibers containing abrasive particles) which are present in the ultrafine fibers-containing portion forming the cleaning sheet of the present invention is not particularly limited, but preferably, having a following relationship:

$$Ma:Mb:Mc=30 \text{ to } 85:15 \text{ to } 70:0 \text{ to } 55$$

wherein Ma is a mass of the ultrafine fibers A, Mb is a mass of the ultrafine fibers B, and Mc is a mass of the function-imparting fibers C.

The ultrafine fibers A, the ultrafine fibers B and optionally the function-imparting fibers C may be uniformly distributed through the entire portion of the ultrafine fibers-containing portion or not uniformly distributed. When the surface portion is composed only of the ultrafine fibers A and the ultrafine fibers B, an excellent removability of the toner and oil may be obtained.

The ultrafine fibers B forming the ultrafine fibers-containing portion of the cleaning sheet of the present invention are preferably press-attachedly deformed in the surface portion containing the contacting surface at a temperature below the softening point of the ultrafine fibers B. When the ultrafine fibers B are press-attachedly deformed at such a temperature, the cleaning sheet of the present invention may be more easily deformed to comply with a shape of the surface of the fuser member, such as a fuser roll, in comparison with the case wherein the ultrafine fibers B are press-bonded at a temperature above a softening point, when the cleaning sheet is brought into contact with the fuser member, such as the fuser roll, and therefore, oil can be uniformly removed, and an oil layer having a uniform thickness can be formed.

The ultrafine fibers B are press-attachedly deformed, preferably at a temperature ranging from a glass transition temperature of the ultrafine fibers B to a temperature lower by 10° C. than a softening point of the ultrafine fibers B, more preferably at a temperature ranging from a temperature higher by 20° C. than a glass transition temperature of the ultrafine fibers B to a temperature lower by 20° C. than a softening point of the ultrafine fibers B.

A pressure applied upon press-attachedly deforming the ultrafine fibers B is not particularly limited, but is preferably 0.3 to 3 kN/cm, more preferably 0.8 to 2 kN/cm.

The term "glass transition temperature" as used herein means a temperature obtained in accordance with a method of JIS K $7121^{-1987}$.

In the ultrafine fibers-containing portion forming the cleaning sheet of the present invention, a ratio of an area of the ultrafine fibers B to a total area of the entire materials forming the ultrafine fibers-containing portion is preferably 15% or more, in a range of from one of the surfaces (i.e., from the contacting surface) contained in the ultrafine fibers-containing portion to a depth of 25 μm therefrom in a thickness direction of the cleaning sheet. When the ultrafine fibers B exist at the area ratio as above, the ultrafine fibers B may be easily softened and the surface portion containing the contacting surface may be deformed, when the cleaning sheet is brought into contact with the fuser member, such as the fuser roll, and therefore, oil can be uniformly removed, and an oil layer having a uniform thickness can be formed.

The above-mentioned area ratio is preferably 20% or more, more preferably 25% or more. An upper limit of the above-mentioned area ratio is not particularly limited, but is preferably 70% or less in view of the relationship between the ultrafine fibers A.

The above-mentioned area ratio means a value obtained from an equation (1):

$$S=(B/T)\times 100 \quad (1)$$

wherein S is an area ratio (%), B is an area that the ultrafine fibers B occupy, and T is an area that the entire materials forming the ultrafine fibers-containing portion, for example, the ultrafine fibers A, the ultrafine fibers B, and optionally, the function-imparting fibers C, occupy. The area that the ultrafine fibers B occupy, and the area that the entire materials forming the ultrafine fibers-containing portion occupy can be measured from, for example, an electron photomicrograph.

The surface portion satisfying the area ratio as above may be formed not only in one surface of the ultrafine fibers-containing portion, i.e., the contacting surface, but also in both surfaces of the ultrafine fibers-containing portion. When the surface portion satisfying the area ratio as above is formed only in one surface, the surface becomes the contacting surface to be brought into contact with the fuser member, such as the fuser roll.

Preferably, the ultrafine fibers-containing portion may further contain thick fibers having a fiber diameter larger than those of the ultrafine fibers A and the ultrafine fibers B, as one of the function-imparting fibers C. The ultrafine fibers-containing portion containing the thick fibers may enhance the strength so that the ultrafine fibers-containing portion can maintain a sufficient strength even when the ultrafine fibers B are softened and deformed after the cleaning sheet of the present invention comes into contact with the fuser member, such as the fuser roll. The thick fibers are preferably composed of resin components that are the same as those forming the ultrafine fibers A and the ultrafine fibers B.

The thick fibers may be incorporated into the ultrafine fibers-containing portion, for example, using dividable fibers, particularly dividable fibers composed of the resin components that are the same as those forming the ultrafine fibers A and the ultrafine fibers B, under the undivided states. In the thick fibers composed of the resin components that are the same as those forming the ultrafine fibers A and the ultrafine fibers B, the manner of the arrangement of the resins is not particularly limited. However, a cross-sectional shape of the fiber is preferably a sheath-core type (including an eccentric type), a side-by-side type, an islands-in-sea type, an orange type or a multiple bimetal type. Of these shapes, the orange type is preferable.

A fiber diameter of the thick fibers is not particularly limited, so long as it is thicker than those of the ultrafine fibers A and the ultrafine fibers B. However, if the fiber diameter of the thick fibers is too big, the smoothness of the contacting surface of the ultrafine fibers-containing portion is affected. Therefore, the fiber diameter of the thick fibers is preferably 10 to 25 $\mu$m, more preferably 12 to 20 $\mu$m.

Preferably, almost all of the thick fibers, more preferably all of the thick fibers, exist in an inner portion of the ultrafine fibers-containing portion that is separated by 10 $\mu$m or more from one of the surfaces (i.e., the contacting surface) contained in the ultrafine fibers-containing portion in a thickness direction of the cleaning sheet, so that the thick fibers do not affect the smoothness of the surface.

The ultrafine fibers-containing portion forming the cleaning sheet of the present invention preferably contains a bundle portion wherein the ultrafine fibers A and the ultrafine fibers B exist in the form of bundles, because the ultrafine fibers A may be firmly attached by the ultrafine fibers B, and thus the ultrafine fibers-containing portion does not cause hairyness when the cleaning sheet comes into contact with the fuser member, such as the fuser roll.

The bundle portion preferably exists in the surface portion containing the contacting surface in the ultrafine fibers-containing portion, so that the above advantageous effects can be easily obtained. The bundle portion does not necessarily exist in a regular manner, but may also exist in an irregular or random manner.

The bundle portion may be in the form of an integrated bundle composed of the ultrafine fibers A and the ultrafine fibers B, and can be recognized by an electron photomicrograph. Further, the bundle portion may be generated by dividing dividable fibers composed of the resin components for forming the ultrafine fibers A and the resin components for forming the ultrafine fibers B in accordance with a dividing method which does not easily perturb orientated directions of the divided ultrafine fibers A and the divided ultrafine fibers B, for example, a dividing method for treating with a water jet under a low pressure.

In a preferred embodiment of the cleaning sheet of the present invention, a flatness percentage of the ultrafine fibers B existing in a portion ranging from one of the surfaces (i.e., the contacting surface) contained in the ultrafine fibers-containing portion to a depth of 10 $\mu$m in a thickness direction is larger than that of the ultrafine fibers B existing in a central portion in the ultrafine fibers-containing portion. In this embodiment, the contacting surface of the ultrafine fibers-containing portion becomes smooth. Therefore, not only oil can be uniformly removed and an oil layer having a uniform thickness be formed, but also the central portion of the ultrafine fibers-containing portion does not become too dense but includes appropriate spaces, and thus, an amount of oil absorbed and an amount of oil to be coated can be increased.

The flatness percentage of the ultrafine fibers B is a value calculated from an equation (2):

$$F=(L_{MIN}/L_{MAX})\times 100 \quad (2)$$

wherein F is a flatness percentage (%), $L_{MIN}$ is a minimum width in a cross-sectional shape of an ultrafine fiber B, and $L_{MAX}$ is a maximum width in a cross-sectional shape of an ultrafine fiber B.

An area density, a thickness and an apparent density of the cleaning sheet are not particularly limited, but when the cleaning sheet is formed only from the ultrafine fibers-containing portion, the area density is preferably 20 to 120 g/m$^2$, more preferably 30 to 100 g/m$^2$, the thickness is preferably 40 to 240 $\mu$m, more preferably 60 to 200 $\mu$m, and the apparent density, that is, a quotient obtained by dividing an area density by a thickness, is preferably 0.3 to 0.7 g/cm$^3$, more preferably 0.4 to 0.6 g/cm$^3$.

In the present specification, the thickness is measured by a micrometer (JIS B 7502: a measuring area=6.3 mm in diameter).

The ultrafine fibers-containing portion forming the cleaning sheet of the present invention may be a woven fabric, a knitted fabric, a nonwoven fabric, or a composite fabric thereof. Of these embodiments, the ultrafine fibers-containing portion preferably comprises a nonwoven fabric, because the fibers may be randomly orientated, and a very smooth contacting surface may be formed, the oil removed efficiently held, and the oil to be coated also efficiently held. More preferably, the ultrafine fibers-containing portion consists essentially of the nonwoven fabric.

The cleaning sheet of the present invention may be composed only of the ultrafine fibers-containing portion, or may be composed of the ultrafine fibers-containing portion and the second fibers-containing portion, as above. The fiber forming the second fibers-containing portion is preferably a fiber having a softening point of more than 230° C., or a fiber having a carbonization temperature of more than 300° C., as this provides a good form stability and strength when it comes into contact with the fuser member, such as the fuser roll. A fiber having a softening point of more than 230° C. is, for example, a polyester fiber, or polyamide fiber, such as 66-nylon, and a fiber having a carbonization temperature of more than 300° C. is, for example, a meta-whole aromatic polyamide fiber, para-whole aromatic polyamide fiber, polyamide imide fiber, aromatic polyether amide fiber, polybenzimidazol fiber, whole aromatic polyester fiber, and so on. The fibers as above may be used alone or in a combination thereof.

When the fibers in the second fibers-containing portion have a fiber diameter of more than 10 μm, a more efficient reinforcing action can be obtained. The second fibers-containing portion does not contain the ultrafine fibers A or the ultrafine fibers B.

The second fibers-containing portion may be formed by laminating a fiber web for forming the ultrafine fibers-containing portion and a fiber web for forming the second fibers-containing portion, and then subjecting the laminate to a fluid jet, such a water jet.

The cleaning sheet of the present invention may be a composite material composed of the ultrafine fibers-containing portion and one or more films, one or more nets, strings, or threads. Further, the cleaning sheet of the present invention may be a composite material composed of the ultrafine fibers-containing portion, the second fibers-containing portion, and one or more films, one or more nets, strings, or threads. In these embodiments, the composite is assembled so that the contacting surface of the ultrafine fibers-containing portion is exposed as one of the surfaces of the cleaning sheet.

The cleaning sheet of the present invention may be prepared by, for example, dividing dividable fibers capable of generating the ultrafine fibers A and the ultrafine fibers B in accordance with a conventional method, when or after the ultrafine fibers-containing portion is formed.

For example, the preferred cleaning sheet having the ultrafine fibers-containing portion formed from a nonwoven fabric may be prepared by the following method:

The dividable fibers capable of generating the ultrafine fibers A and the ultrafine fibers B are prepared, and if necessary, the function-imparting fibers C are also prepared. The dividable fibers may contain the resin component or components for the ultrafine fibers A as above and the resin component or components for the ultrafine fibers B as above, and in addition thereto, optionally other resin component or components.

The resin components of the dividable fiber may be arranged so that a cross-sectional shape of the fiber is a sheath-core type (including an eccentric type), a side-by-side type, an islands-in-sea type, an orange type, or a multiple bimetal type. The orange type or a multiple bimetal type is preferable, as these allow the ultrafine fibers A having a non-circular cross-sectional shape to be easily produced.

The dividable fiber may be divided by a physical action (a fluid jet, such as a water jet, calendaring, needle-punching, or flat-pressing) or a chemical action (a removal or swelling of one or more resin components). A preferable dividable fiber is physically dividable, as this allows a nonwoven fabric having a dense and smooth contacting surface to be obtained.

A fineness of the dividable fiber is not particularly limited, so long as it can generate the ultrafine fibers A having a fiber diameter of 10 μm or less, and the ultrafine fibers B having a fiber diameter of 10 μm or less. A fiber length of the dividable fiber is preferably 1 to 160 mm, more preferably 3 to 110 mm, so that the dividable fibers can be uniformly distributed.

Then, a fiber web containing the dividable fibers is prepared. When the cleaning sheet consisting essentially of the ultrafine fibers-containing portion is prepared, merely a fiber web containing the dividable fibers is also prepared. When the cleaning sheet composed of the ultrafine fibers-containing portion and the second fibers-containing portion is prepared, a fiber web containing the dividable fibers for the ultrafine fibers-containing portion and a fiber web not containing the dividable fibers for the second fibers-containing portion are also prepared.

A method for forming a fiber web is, for example, a wet-laid method or a dry-laid method, such as a carding method, an air-laying method, a spun-bonding method, or a melt-blown method.

The fiber web for forming the ultrafine fibers-containing portion contains preferably 50 mass % or more, more preferably 70 mass % or more, of the dividable fibers, so as to easily form. the cleaning sheet having a smooth contacting surface from the ultrafine fibers A and the ultrafine fibers B.

The fiber web for forming the ultrafine fibers-containing portion and the fiber web for forming the second fibers-containing portion may be prepared by the same method or by different methods, respectively, and the resulting fiber webs may be laminated. In particular, a fiber web prepared by orientating the fibers in the fiber web containing fibers orientated in a lengthwise direction of the fiber web by a cross-layer so that the orientated directions are crossed to the lengthwise direction is preferable as a fiber web for forming the ultrafine fibers-containing portion, as this allows a nonwoven fabric wherein the fibers can come into linear contact with the toners on the surface of the fuser member, such as the fuser roll, to be easily prepared.

Thereafter, it is preferable to subject at least the fiber web for forming the ultrafine fibers-containing portion to a fluid jet, such as a water jet, to divide the dividable fibers and entangle the ultrafine fibers A and the ultrafine fibers B. The entanglement can enhance a resistance of the surface, and prevent a generating of feathering during a cleaning treatment.

The fluid jet is not particularly limited, so long as it can divide the dividable fibers and entangle the ultrafine fibers A and the ultrafine fibers B. For example, a fluid jet under a pressure of 1 to 30 MPa may be ejected onto the fiber web from a nozzle plate containing one or more lines of nozzles having a diameter of 0.05 to 0.3 mm and a pitch of 0.2 to 3 mm. The fluid jet may be applied to one side or both sides of the fiber web for forming the ultrafine fibers-containing portion, once or more times. If the fluid jet is applied on one side, a side to become the contacting surface is treated. If a supporter, such as a net or a perforated plate, for carrying the fiber web for forming the ultrafine fibers-containing portion thereon when treated with the fluid jet contains thick supporting portions (non-opening portions), the resulting nonwoven fabric (i.e., the resulting cleaning sheet) contains pores having a large diameter, and a smoothness of the contacting surface is liable to be impaired. Therefore, it is preferable to use a supporter that contains supporting portions having a thickness of 0.25 mm or less.

Then, the fiber web for forming the ultrafine fibers-containing portion to which the fluid jet has been subjected, and optionally the fiber web for forming the second fibers-containing portion, are treated at a temperature lower than a softening point of the ultrafine fibers B, preferably a temperature ranging from a glass transition temperature of the ultrafine fibers B to a temperature lower by 10° C. than a softening point of the ultrafine fibers B, more preferably at a temperature ranging from a temperature higher by 20° C. than a glass transition temperature of the ultrafine fibers B to a temperature lower by 20° C. than a softening point of the ultrafine fibers B, under a pressure of preferably 0.3 to 3 kN/cm, more preferably 0.8 to 2 kN/cm, whereby the ultrafine fibers B are press-attachedly deformed to obtain a nonwoven fabric which may be used for the cleaning sheet of the present invention.

When the ultrafine fibers B are press-attachedly deformed, heat and pressure are not necessarily applied at the same time. For example, a nonwoven fabric, i.e., the cleaning sheet, may be prepared by first heating, and then later pressing.

When the ultrafine fibers B are press-attachedly deformed under the simultaneous actions of heat and pressure, for example, a calendar roll or a flat pressing machine may be used. When the ultrafine fibers B are first heated, and then pressed, for example, a hot-air drier may be used first and then a pair of rolls used for passing therethrough and pressing.

A preferable cleaning sheet of the present invention wherein a ratio of an area of the ultrafine fibers B to a total area of entire materials forming the ultrafine fibers-containing portion is 15% or more in a range from one of the surfaces (the contacting surface) in the ultrafine fibers-containing portion to a depth of 25 $\mu$m therefrom in a thickness direction of the cleaning sheet may be prepared, for example, by utilizing a fiber web containing 50 mass % or more of dividable fibers as the fiber web for forming the ultrafine fibers-containing portion, and arranging the fiber web containing dividable fibers at the position for forming the contacting surface therefrom.

A preferable cleaning sheet of the present invention wherein the ultrafine fibers-containing portion contains thick fibers having a diameter larger than those of the ultrafine fibers A and the ultrafine fibers B, and the thick fiber contains a portion of a resin from which the ultrafine fibers A are made, and a portion of a resin from which the ultrafine fibers B are made may be prepared, particularly a preferable cleaning sheet of the present invention wherein the thick fibers exist 10 $\mu$m or more apart from one of the surfaces (the contacting surface) contained in the ultrafine fibers-containing portion in a thickness direction of the ultrafine fibers-containing portion may be prepared, for example, by utilizing mechanically dividable fibers, and subjecting the dividable fibers to a fluid jet having a relatively weak pressure to divide only the dividable fibers existing in the contacting surface in the surface portion, or by fixing the dividable fibers by press-attachedly deforming or fusing at least one resin component forming the dividable fibers, and subjecting the fixed dividable fibers to a fluid jet to carry out the dividing of the dividable fibers existing only in the contacting surface in the surface portion, or the like.

As a preferable cleaning sheet of the present invention, a nonwoven fabric, i.e., the cleaning sheet, containing a bundle portion of the ultrafine fibers A and the ultrafine fibers B, particularly a nonwoven fabric, i.e., the cleaning sheet, containing the bundle portion in the surface portion containing the contacting surface of the ultrafine fibers-containing portion, may be prepared, for example, by utilizing mechanically dividable fibers, and subjecting the dividable fibers to a fluid jet of a relatively weak pressure, so as not to completely divide and disperse the dividable fibers existing in the contacting surface in the surface portion, or by fixing the dividable fibers by press-attachedly deforming or fusing at least one resin component forming the dividable fibers, and subjecting the fixed dividable fibers to a fluid jet while suppressing the dispersion of the divided fibers, or the like.

A preferable cleaning sheet of the present invention wherein a flatness percentage of the ultrafine fibers B existing in a portion ranging from a contacting surface contained in the ultrafine fibers-containing portion to a depth of 10 $\mu$m in a thickness direction is larger than that of the ultrafine fibers B existing in a central portion in the ultrafine fibers-containing portion may be prepared, for example, by press-attachedly deforming the ultrafine fibers B at a temperature below the softening point thereof, preferably at a temperature ranging from a glass transition temperature of the ultrafine fibers B to a temperature lower by 10° C. than a softening point of the ultrafine fibers B, more preferably at a temperature ranging from a temperature higher by 20° C. than a glass transition temperature of the ultrafine fibers B to a temperature lower by 20° C. than a softening point of the ultrafine fibers B, or by press-attachedly deforming the ultrafine fibers B under a relatively weak pressure, or by combining the above conditions.

The cleaning sheet of the present invention may contain oil, to enhance a release property of the toner on the surface of the fuser member, such as the fuser roll.

The oil is, for example, a silicone oil, such as methyl silicone oil, dimethyl silicone oil, ethyl silicone oil, phenyl silicone oil, amino-modified silicone oil, epoxy-modified silicone oil, mercapto-modified silicone oil, and 3,3,3-trifluoropropyl silicone oil. The above-mentioned oil may be used alone or in combination thereof.

An amount of oil contained in the cleaning sheet varies with the thickness of the cleaning sheet or the like, but it is preferably 10 to 120 g/m$^2$.

The viscosity of the oil is preferably 10 to 30,000 centistokes, as this allows the oil to be thoroughly diffused on the fuser member.

The oil can be incorporated into the cleaning sheet prepared as above by immersing the cleaning sheet in the oil, or spraying or coating the cleaning sheet with the oil.

Figure 4:
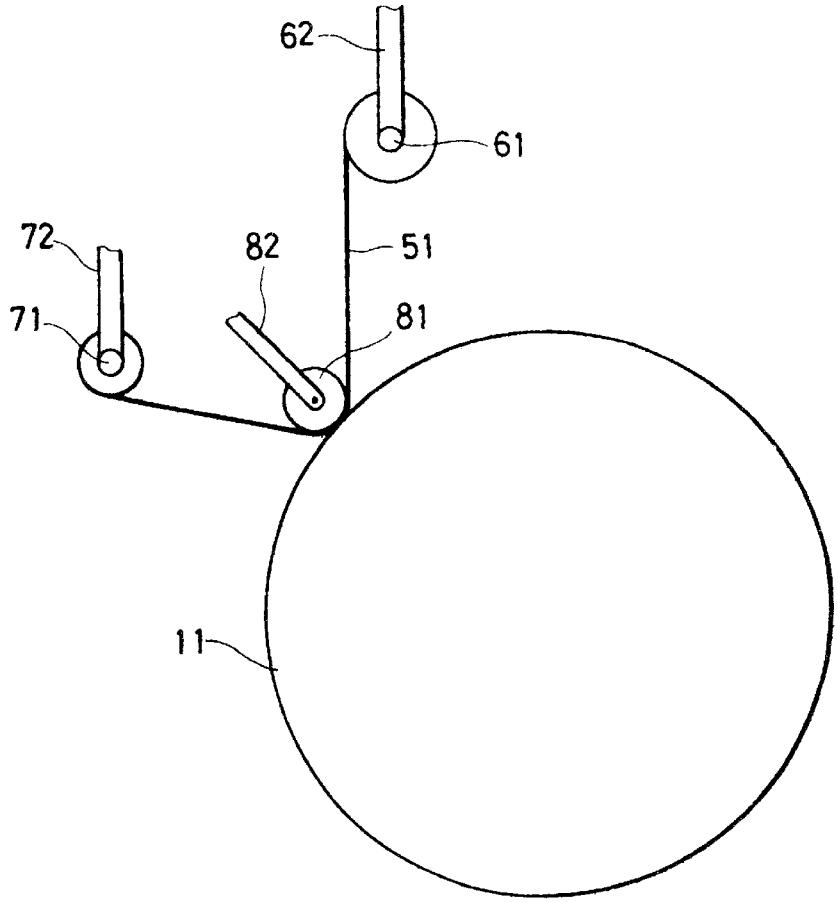
FIG. 4 is a sectional view schematically illustrating a cleaning sheet supplier of the present invention and a cleaning apparatus of the present invention.

The cleaning sheet supplier of the present invention comprises, for example, as shown in FIG. 4, the cleaning sheet 51 as above, a supply shaft 61 around which the cleaning sheet 51 is wound from an end thereof, and a take-up shaft 71 to which other end of the cleaning sheet 51 is fixed. Therefore, the cleaning sheet supplier is always able to bring a fresh cleaning sheet 51 into contact with a surface of a fuser member, such as a fuser roll 11, by successively supplying the cleaning sheet 51, and therefore, oil on the surface of the fuser member can be removed while providing a remaining oil layer having a uniform thickness, and the oil can be applied so that the thickness of the oil applied is uniform.

A method for fixing the cleaning sheet 51 to the take-up shaft 71 is, for example, (1) fixing with a double-coated adhesive tape, (2) fixing with a fusible resin such as a hot-melt resin, (3) fixing by heat-fusing the take-up shaft 71, where the take-up shaft 71 is made of a thermoplastic resin, (4) fixing of the cleaning sheet 51 with a pin fixed on the take-up shaft 71 or the like, by inserting the pin into the cleaning sheet 51, (5) fixing of the cleaning sheet 51 with a groove formed on the take-up shaft 71 by inserting the cleaning sheet 51 into the groove, and so on. When the above methods (1) to (3) are used to fix the cleaning sheet 51, the cleaning sheet 51 may be entirely or partially fixed to the take-up shaft 71. For the supplying shaft 61, it is not necessary to fix the cleaning sheet 51 on the supplying shaft 61, as the cleaning sheet 51 may be merely wound onto the supplying shaft 61.

The cleaning apparatus of the present invention comprises, for example, as shown in FIG. 4, the cleaning sheet supplier as above, holding means 62, 72 for the cleaning sheet supplier, a conveying means for the cleaning sheet (such as a rotating means of the take-up shaft 71), and a pressing means 82 for pressing the cleaning sheet 51 to a fuser member. Instead of the holding means 62, 72 as shown in FIG. 4, the supplying shaft 61 and/or the take-up shaft 71 may be directly mounted on an appropriate holding device (not shown) in a housing of the cleaning apparatus. The cleaning apparatus of the present invention is always able to bring a fresh cleaning sheet 51 into contact with a surface of a fuser member, such as a fuser roll 11, by successively supplying the cleaning sheet 51, and therefore, oil on the surface of the fuser member can be removed while providing a remaining oil layer having a uniform thickness, and the oil can be applied so that the thickness of the oil applied is uniform.

In the cleaning apparatus of the present invention, the pressing means 82 for pressing the cleaning sheet to a fuser member may be, for example, a bar having a circular or polygonal (such as quadrilateral, or hexagonal) sectional shape. Of these, it is preferable to use a bar having a circular sectional shape, as this allows the cleaning sheet to be brought into uniform contact with the fuser member, oil on the surface of the fuser member to be removed while providing a remaining oil layer having a uniform thickness, and the oil can be applied so that the thickness of the oil applied is uniform.

The bar preferably has an elasticity and heat-resistance, and is preferably made of, for example, an expanded or non-expanded silicone rubber.

A pressing force of the bar to the surface of the fixing member preferably corresponds to an action width (i.e., a nip width) of 2 to 5 mm against the surface of the fixing member, so that oil on the surface of the fuser member can be removed while providing a remaining oil layer having a uniform thickness, and the oil can be applied so that the thickness of the oil applied is uniform.

Further, the cleaning sheet is pressed by the bar against the fuser member so that the surface (the contacting surface) containing the press-attachedly deformed ultrafine fibers B in the ultrafine fibers-containing portion forming the cleaning sheet is brought into contact with the fuser member.

The fuser member which may be treated by the cleaning sheet of the present invention is, for example, a fuser roll in electronic photography apparatuses, such as copying machines, laser beam printers, or facsimiles. Other examples of the fuser member may be (1) a circulating belt capable of coming into contact with a surface of a fuser roll while circulating, and directly fixing a toner on a printing sheet instead of the fuser roll, or (2) a transfer roll which is installed so as to come into contact with a fuser roll or a circulating belt, and to which a toner and oil are transferred.

EXAMPLES

The present invention will now be further illustrated by, but is by no means limited to, the following Examples.

Example 1

Figure 5:
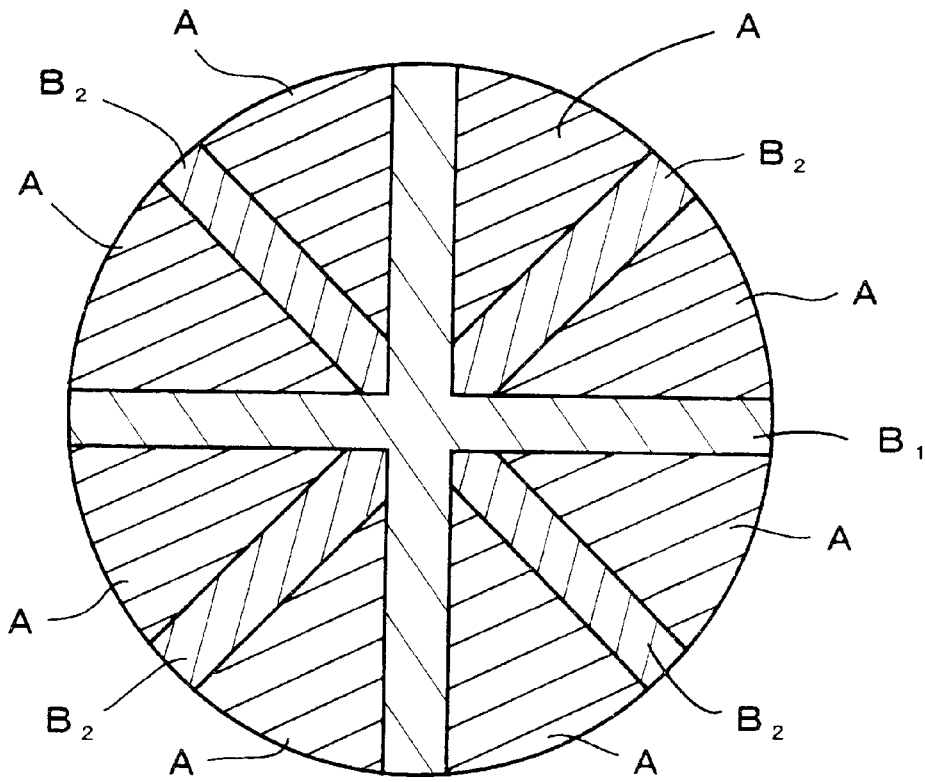
FIG. 5 is a sectional view schematically illustrating a structure of a dividable fiber used for preparing a cleaning sheet of the present invention in Example 1.

Dividable fibers having a cross-sectional shape as shown in FIG. 5 were prepared. Specifically, dividable fibers (fineness=2.2 dtex; fiber length=38 mm; a mass ratio of polyethylene terephthalate and nylon 6=7:3) wherein a cross-sectional shape of the fiber was an orange-type, and polyethylene terephthalate (softening point=238° C.; A in FIG. 5) was divided into 8 parts by nylon 6 (glass transition temperature=48° C.; softening point=180° C.; $B_1$, $B_2$ in FIG. 5) extending from an axis of the fiber were prepared. From the dividable fibers, eight ultrafine fibers A made of polyethylene terephthalate, and having an almost triangular cross-sectional shape and a fiber diameter of 4.2 $\mu$m, one ultrafine fiber $B_1$ made of nylon 6, and having an almost X-letter-like cross-sectional shape and a fiber diameter of 6 $\mu$m, and four ultrafine fibers $B_2$ made of nylon 6, and having an almost I-letter-like cross-sectional shape and a fiber diameter of 3 $\mu$m were able to be obtained by a mechanical action.

Then, the dividable fibers (100%) were carded by a carding machine to form a unidirectional fiber web (area density=20 g/m$^2$) wherein fibers were orientated in a lengthwise direction, as a part of a fiber web for the ultrafine fibers-containing portion.

Further, another unidirectional fiber web was prepared as in the above method, and then a crossed fiber web (area density=60 g/m$^2$) formed therefrom by cross-orientating the fibers to a direction crossing against the lengthwise direction by a cross-layer, as a part of a fiber web for the ultrafine fibers-containing portion.

Subsequently, the unidirectional fiber web and the crossed fiber web were laminated, and the laminated fiber web was mounted on a net having a line thickness (non-opening) of 0.15 mm. A water jet was ejected onto the crossed fiber web side of the laminated fiber web from a nozzle plate containing one line of nozzles having a diameter of 0.13 mm and a pitch of 0.6 mm under a pressure of 5 Mpa. Then, a water jet was ejected onto the unidirectional fiber web side from the same nozzle plate under a pressure of 5 Mpa. Thereafter, a water jet was further ejected from the same nozzle plate under a pressure of 5 Mpa onto the crossed fiber web side, and then onto the unidirectional fiber web side, to thereby divide the dividable fibers in the laminated fiber web, and generate, and at the same time, entangle, the ultrafine fibers A (softening point=238° C.; sectional shape of fiber=almost triangle; fiber diameter=4.2 $\mu$m), the ultrafine fibers $B_1$ (glass transition temperature=48° C.; softening point=180° C.; sectional shape of fiber=almost X-letter; fiber diameter=6 $\mu$m) and the ultrafine fibers $B_2$ (glass transition temperature=48° C.; softening point=180° C.; sectional shape of fiber=almost I-letter; fiber diameter=3 $\mu$m), and obtain an entangled nonwoven fabric.

The resulting entangled nonwoven fabric was passed between a steel roll at 90° C. and a cotton roll under a linear pressure of 1.5 kN/cm in such a manner that the surface of the crossed fiber web side was brought into contact with the steel roll, whereby only the ultrafine fibers B existing in the surface portion in the entangled nonwoven fabric were press-attachedly deformed, while the ultrafine fibers B existing in the portion other than the surface portions in the entangled nonwoven fabric were not press-attachedly deformed, and a press-attachedly deformed and entangled nonwoven fabric, i.e., a cleaning sheet, having an area density of 80 g/m$^2$, a thickness of 160 $\mu$m, and an apparent density of 0.5 g/cm$^3$ was obtained.

Electron photomicrographs of the surface and the cross-section (in a thickness direction) of the cleaning sheet were taken and examined, and the following of findings obtained:

In the section of a thickness direction of the cleaning sheet, i.e., the press-attachedly deformed and entangled nonwoven fabric, a ratio of an area of the ultrafine fibers B to a total area of entire materials forming the cleaning sheet was about 34%, in a range from the surface (stemming from the crossed fiber web) to a depth of 25 μm therefrom. Further, in a range from the other surface (stemming from the unidirectional fiber web) to a depth of 25 μm therefrom, a ratio of an area of the ultrafine fibers B to a total area of entire materials forming the cleaning sheet was also about 34%.

In the cleaning sheet, i.e., the press-attachedly deformed and entangled nonwoven fabric, all the thick fibers having a fiber diameter of 15 μm and the orange-type sectional shape, wherein polyethylene terephthalate was divided by nylon 6 extending from an axis of the fiber, were randomly present in a portion apart by 10 μm or more from both surfaces of the cleaning sheet in a cross-section in a thickness direction.

Further, bundle portions composed of the bundles of the ultrafine fibers A and the ultrafine fibers B randomly existed in the both surface portions of the cleaning sheet.

A flatness percentage of the ultrafine fibers B existing in a portion ranging from one surface of the cleaning sheet to a depth of 10 μm in a thickness direction, a flatness percentage of the ultrafine fibers B existing in a portion ranging from the other surface of the cleaning sheet to a depth of 10 μm in a thickness direction were larger than that of the ultrafine fibers B existing in a central portion in the cleaning sheet.

The resulting cleaning sheet was dipped in a bath of dimethyl silicone oil having a viscosity of 100 CS (centistokes), and passed between a pair of rolls to remove an excess amount of oil, and thereby obtain a cleaning sheet containing dimethyl silicone oil (70 g/m$^2$).

Comparative Example

Polyethylene terephthalate ultrafine fibers (softening point=238° C.; sectional shape=circle; fiber diameter=8.7 μm; fineness=0.83 dtex; fiber length=38 mm) and meta-type aromatic polyamide ultrafine fibers (carbonization temperature=400° C.; sectional shape=circle; fiber diameter=8.4 μm; fineness=0.78 dtex; fiber length=38 mm) were prepared, respectively.

Then, 30 mass % of the polyethylene terephthalate ultrafine fibers and 70 mass % of the meta-type aromatic polyamide ultrafine fibers were mixed and carded by a carding machine to form a unidirectional fiber web (area density=20 g/m$^2$) wherein fibers were orientated in a lengthwise direction thereof.

Further, another unidirectional fiber web was prepared as in the above method, and then a crossed fiber web (area density=60 g/m$^2$) was formed therefrom by cross-orientating the fibers to a direction crossing against the lengthwise direction by a cross-layer.

Subsequently, the procedures described in the above Example 1 were repeated, except that the unidirectional fiber web prepared in the Comparative Example and the crossed fiber web prepared in the Comparative Example were laminated, and a pressure of a water jet was 15 Mpa, and thus, an entangled nonwoven fabric was obtained.

The resulting entangled nonwoven fabric was passed between a steel roll at 240° C. and a cotton roll under a linear pressure of 2 kN/cm in such a manner that the surface of the crossed fiber web side was brought into contact with the steel roll, whereby the polyethylene terephthalate ultrafine fibers were softened and deformed to fix the meta-type aromatic polyamide ultrafine fibers, and a fixed nonwoven fabric, i.e., a cleaning sheet, having an area density of 80 g/m$^2$, a thickness of 160 μm, and an apparent density of 0.5 g/cm$^3$ was obtained.

Thereafter, a cleaning sheet containing dimethyl silicone oil (70 g/m$^2$) was prepared as in the above Example 1.

Evaluations of the Cleaning Sheets (1) Evaluation of Oil Flatness

A color copying machine equipped with a fixing apparatus containing a fuser roll having a surface of an RTV silicone rubber (thickness=1 mm; surface temperature=170° C.) and a pressing roll having a surface of an RTV silicone rubber (thickness=2 mm) was used. Each of the rolls contained a heater, respectively.

The oil-containing cleaning sheet prepared in Example 1 or Comparative Example was installed so that it was possible to convey the cleaning sheet in a direction opposite to a rotating direction of the fuser roll, to bring the surface stemming from the crossed fiber web into contact with the fuser roll, and to press the cleaning sheet against the fuser roll by a cylindrical pinch roll of an expanded silicone rubber at a pressing force of 0.04 kg/cm and a nip width of 4 mm.

A photographic image was reproduced successively on 10 OHP films used as a printing sheet.

Subsequently, the 10th OHP film was projected by a projector, and oil stripes were visually observed.

It was found that no oil striping was observed in the 10th OHP film treated with the cleaning sheet prepared in Example 1, whereas faint oil strips were observed in the 10th OHP film treated with the cleaning sheet prepared in Comparative Example. The results show that an oil layer having a uniform thickness can be formed by the cleaning sheet of the present invention.

(2) Evaluation of the Oil Applicability

As in the above item (1), the oil-containing cleaning sheet prepared in Example 1 or Comparative Example was installed so that it was possible to convey the cleaning sheet at a rate of 0.3 mm per 1 sheet of A4 size. Then, 10 OHP films were successively passed between the fuser roll and the pressing roll. An amount of oil on the OHP film was calculated from the masses before and after passage through the rolls.

It was found that the amounts of oil applied on the OHP films treated with the cleaning sheet prepared in Example 1 ranged from 1.5 mg to 2.5 mg per a sheet of the OHP film, whereas the amounts of oil applied on the OHP films treated with the cleaning sheet prepared in Comparative Example ranged from 1.0 to 7.0 mg per a sheet of the OHP film. The results show that an oil layer having a uniform thickness can be formed by the cleaning sheet of the present invention.

As explained, according to the present invention, the cleaning sheet having excellent properties for the wiping off of a toner and oil is provided. This is believed to be because the cleaning sheet of the present invention contains the ultrafine fibers A in a surface to be brought into contact with the fuser member, such as a fuser roll, and the ultrafine fibers B are not fused, but press-attachedly deformed. Further, the cleaning sheet of the present invention has a smooth surface, has a large area able to come into contact with the fuser member, such as a fuser roll, exhibits an excellent oil removability, and is capable of forming an oil layer having a uniform thickness. This is believed to be because the surface to come into contact with the fuser member, such as a fuser roll, contains the ultrafine fibers B in the press-attachedly deformed state. Furthermore, the cleaning sheet of the present invention provides a far greater removability of the oil, and can form a more uniform oil layer, in comparison with conventional cleaning sheets. This is also believed to be because the ultrafine fibers B in the cleaning sheet of the present invention are softened when brought into contact with the fuser member, such as the fuser roll, having a surface temperature of about 150° C. to 200° C., and therefore, the cleaning sheet of the present invention can be deformed along the shape of the fuser member.

According to the cleaning sheet of the present invention, as above, the oil removal is excellent, an oil layer having a uniform thickness can be formed, a lifetime of a fuser member, such as a fuser roll, is not shortened or mechanical vibration does not occur because it is not necessary to apply a strong pressure to the cleaning sheet against a fuser member, such as a fuser roll, and a release property of a toner is not impaired because it is not necessary to reduce an amount of oil coated on a fuser member, such as a fuser roll, only by making use of the cleaning sheet of the present invention as a conventional cleaning sheet.

Further, the cleaning sheet supplier of the present invention can always bring a fresh surface of the cleaning sheet into contact with a surface of a fuser member, such as a fuser roll, and therefore, oil on the surface of the fuser member can be uniformly removed, and an oil layer with a uniform thickness can be formed.

Further, the cleaning apparatus of the present invention can always bring a fresh surface of the cleaning sheet into contact with a surface of a fuser member, such as a fuser roll, and therefore, oil on the surface of the fuser member can be uniformly removed, and an oil layer with a uniform thickness can be formed.

Although the present invention has been described with reference to specific embodiments, various changes and modifications obvious to those skilled in the art are deemed to be within the spirit, scope, and concept of the invention.

What is claimed is:

1. A cleaning sheet for a fuser member, comprising an ultrafine fibers-containing portion including (a) first ultrafine fibers formed from a resin having a softening point of higher than 230° C., having a non-circular cross-sectional shape, and having a fiber diameter of not more than 10 $\mu$m, and (b) second ultrafine fibers formed from a resin having a softening point of 150 to 230° C., and having a fiber diameter of not more than 10 $\mu$m, wherein at least one surface of said cleaning sheet is contained in said ultrafine fibers-containing portion, and said second ultrafine fibers in a surface portion containing said surface are deformed by press-attaching.

2. The cleaning sheet according to claim 1, wherein said second ultrafine fibers are press-attachedly deformed at a temperature lower than a softening point of said second ultrafine fibers.

3. The cleaning sheet according to claim 1, wherein a ratio of an area of said second ultrafine fibers to a total area of entire materials forming said ultrafine fibers-containing portion is at least 15%, in a range of from one of said surfaces contained in said ultrafine fibers-containing portion to a depth of 25 $\mu$m therefrom in a thickness direction of said cleaning sheet.

4. The cleaning sheet according to claim 1, wherein said ultrafine fibers-containing portion further contains thick fibers having a fiber diameter larger than those of said first and second ultrafine fibers.

5. The cleaning sheet according to claim 4, wherein said thick fiber contains a portion of a resin from which said first ultrafine fibers are made, and a portion of a resin from which said second ultrafine fibers are made.

6. The cleaning sheet according to claim 4, wherein said thick fibers exist at least 10 $\mu$m apart from said surface contained in said ultrafine fibers-containing portion in a thickness direction of said cleaning sheet.

7. The cleaning sheet according to claim 1, wherein said ultrafine fibers-containing portion contains a bundle portion wherein said first ultrafine fibers and said second ultrafine fibers exist in the form of a bundle.

8. The cleaning sheet according to claim 7, wherein said bundle portion exists in a surface portion in said ultrafine fibers-containing portion.

9. The cleaning sheet according to claim 1, wherein a flatness percentage of said second ultrafine fibers existing in a portion ranging from one surface contained in said ultrafine fibers-containing portion to a depth of 10 $\mu$m in a thickness direction is larger than that of said second ultrafine fibers existing in a central portion in said ultrafine fibers-containing portion.

10. A supplier of a cleaning sheet for a fuser member, comprising said cleaning sheet according to claim 1, a supply shaft around which said cleaning sheet is wound from an end thereof, and a take-up shaft to which another end of said cleaning sheet is fixed.

11. A cleaning apparatus for a fuser member, comprising said supplier according to claim 10, a means for holding said supplier of said cleaning sheet, a means for conveying said cleaning sheet of said supplier, and a means for pressing said cleaning sheet to a fuser member.

* * * * *